US006209172B1

(12) United States Patent
Bradley

(10) Patent No.: US 6,209,172 B1
(45) Date of Patent: Apr. 3, 2001

(54) ACCESS DOOR HINGE ARRANGEMENT FOR METER BOX COVER

(75) Inventor: Earl T. Bradley, Cisco, TX (US)

(73) Assignee: EBAA Iron, Inc., Eastland, TX (US)

( * ) Notice: Subject to any disclaimer, the term of this patent is extended or adjusted under 35 U.S.C. 154(b) by 0 days.

(21) Appl. No.: 09/360,194

(22) Filed: Jul. 23, 1999

(51) Int. Cl.[7] ..... E05D 7/10; E05D 5/00
(52) U.S. Cl. ..... 16/261; 16/263; 16/382
(58) Field of Search ..... 16/261, 254, 262, 16/264, 263, 229, 221, 382, 252; 220/4.02, 836, 843, 845, 532, 533; 312/223.1, 326, 329; 174/50, 66, 67; 49/381, 501

(56) References Cited

U.S. PATENT DOCUMENTS

| | | | | |
|---|---|---|---|---|
| 39,554 | | 8/1863 | Davis . | |
| 913,504 | | 2/1909 | Jones . | |
| 1,300,528 | | 4/1919 | Weeks . | |
| 2,200,399 | | 5/1940 | Primas . | |
| 2,347,981 | | 5/1944 | Apfelbaum . | |
| 2,627,995 | | 2/1953 | Waterman . | |
| 2,646,187 | | 7/1953 | Roop . | |
| 2,734,222 | | 2/1956 | Kiba . | |
| 2,797,840 | | 7/1957 | Gibbs . | |
| 2,858,039 | | 10/1958 | Gibbs . | |
| 3,455,059 | * | 7/1969 | Evans, III | 16/263 |
| 3,605,718 | | 9/1971 | Winters . | |
| 3,978,550 | * | 9/1976 | Brown | 16/382 |
| 3,997,939 | * | 12/1976 | Wilhelmsen | 16/382 |
| 4,162,740 | | 7/1979 | Jones . | |
| 4,227,283 | | 10/1980 | Mathewson et al. . | |
| 4,271,539 | * | 6/1981 | Roberts | 16/382 |
| 4,478,005 | * | 10/1984 | Mundschenk | 49/397 |
| 4,800,238 | | 1/1989 | Gesvent . | |
| 5,022,529 | | 6/1991 | Kang . | |
| 5,327,682 | * | 7/1994 | Holtz | 16/361 |
| 5,358,135 | | 10/1994 | Robbins et al. . | |

* cited by examiner

*Primary Examiner*—Chuck Mah
(74) *Attorney, Agent, or Firm*—Akin, Gump, Strauss, Hauer & Feld, LLP

(57) ABSTRACT

A hinge connection between an access door and a panel, such as a utility meter box cover, is formed by opposed cylindrical hinge pins which are integrally cast as part of the access door, and spaced-apart channel-shaped recesses formed in bosses which are cast as part of the panel facing a side of the panel opposite a planar wall part of the panel, which wall part includes an opening for receiving the access door. The hinge pins are supported in the channel-shaped recesses and are retained therein by conventional hex head machine bolt and nut assemblies which project through respective bores in the panel or meter box cover and intersect the channel-shaped recesses. The bolt heads are disposed in elongated slots opening to the planar surface of the panel or meter box cover and having widths only slightly greater than the distance across the flats of the bolt heads, respectively.

16 Claims, 3 Drawing Sheets

ACCESS DOOR HINGE ARRANGEMENT FOR METER BOX COVER

FIELD OF THE INVENTION

The present invention pertains to an improved hinge connection between an access door and a panel or cover member and is particularly adapted for a hinge connection between an access door and a utility meter box cover.

BACKGROUND

There are various structures wherein a hinge connection is required between a panel, cover member or similar structure and an access door in the panel or cover member and wherein the hinge connection is, desirably, uncomplicated and of rugged construction. One structural arrangement wherein a rugged hinge connection is desirable is between an access door and a panel or cover member for utility meter boxes. Typically, a utility meter for gas or water, for example, is disposed in a cast metal or plastic box having a removable cast metal or plastic cover which faces in a direction which provides access to the meter through a door hingedly connected to the meter box cover. In such an application the constructions of the door and the box cover are usually cast metal, such as ductile iron, or molded reinforced or non-reinforced plastic, and the parts are typically constructed wherein minimal or no machining operations are required so that the parts are finished as cast. Typical prior art meter box cover and access door arrangements include a hinge that comprises a hinge pin or rod which requires special coring or drilling operations to be used during the casting and finish fabrication of the access door or the box cover. These operations are complicated and undesirable when manufacturing inexpensive parts such as are required for certain articles including meter boxes and the like. Still further, it is desirable to provide an arrangement of a meter box cover and access door which cannot be readily disassembled from the exterior of the box cover by disconnecting the hinge structure, so that access to the meter box is only permitted through the use of a special tool or key to unlatch the access door.

In all events, it is desirable to provide inexpensive, rugged and uncomplicated parts for the hinge connections between access doors and associated panels or covers, such as the above-mentioned utility meter box application. It is to these ends that the present invention has been developed.

SUMMARY OF THE INVENTION

The present invention provides an improved hinge connection between an access door and a panel or cover member, particularly wherein the access door is provided as part of a utility meter box cover, for example.

In accordance with one aspect of the present invention, a hinge connection between an access door and a panel or cover member is provided wherein the access door includes opposed integral hinge pin members which are cast or formed as part of the door and which simplifies the fabrication of the door. The hinge pins fit within integral hinge-receiving channels or recesses which are formed as part of an integral boss structure provided as part of the panel or meter box cover, for example.

Still further in accordance with the invention, a hinge connection between an access door and a panel or meter box cover is provided wherein hinge pins on the access door are retained in hinge pin-receiving channels or recesses in the panel or cover member by conventional machine bolt and nut assemblies. In particular, the bolt and nut assemblies may comprise hexhead bolts which are disposed within spaced apart elongated slots formed in the panel or cover member and which are dimensioned such that the bolt heads are non-rotatable within the slots, respectively. In this way, the assembly of the access door to the panel or cover member is simplified and once the assembly is completed and the panel or cover is assembled to associated structure, the hinge-retaining bolt and nut assemblies are not removable from the exterior of the panel or cover member.

Those skilled in the art will appreciate that the provision of the access door-to-meter box hinge connection of the present invention is advantageous. The hinge pins are cast or molded as part of the access door and hinge-receiving channels are cast or molded integrally into the panel or cover supporting the access door. Conventional threaded fasteners are provided for retaining the hinge pins in the pin-receiving channels or recesses. Uncomplicated assembly and disassembly processes only are required.

Those skilled in the art will further appreciate the above-mentioned advantages and superior features of the invention upon reading the detailed description which follows in conjunction with the drawings.

DETAILED DESCRIPTION OF PREFERRED EMBODIMENTS

Figures 1, 1A:
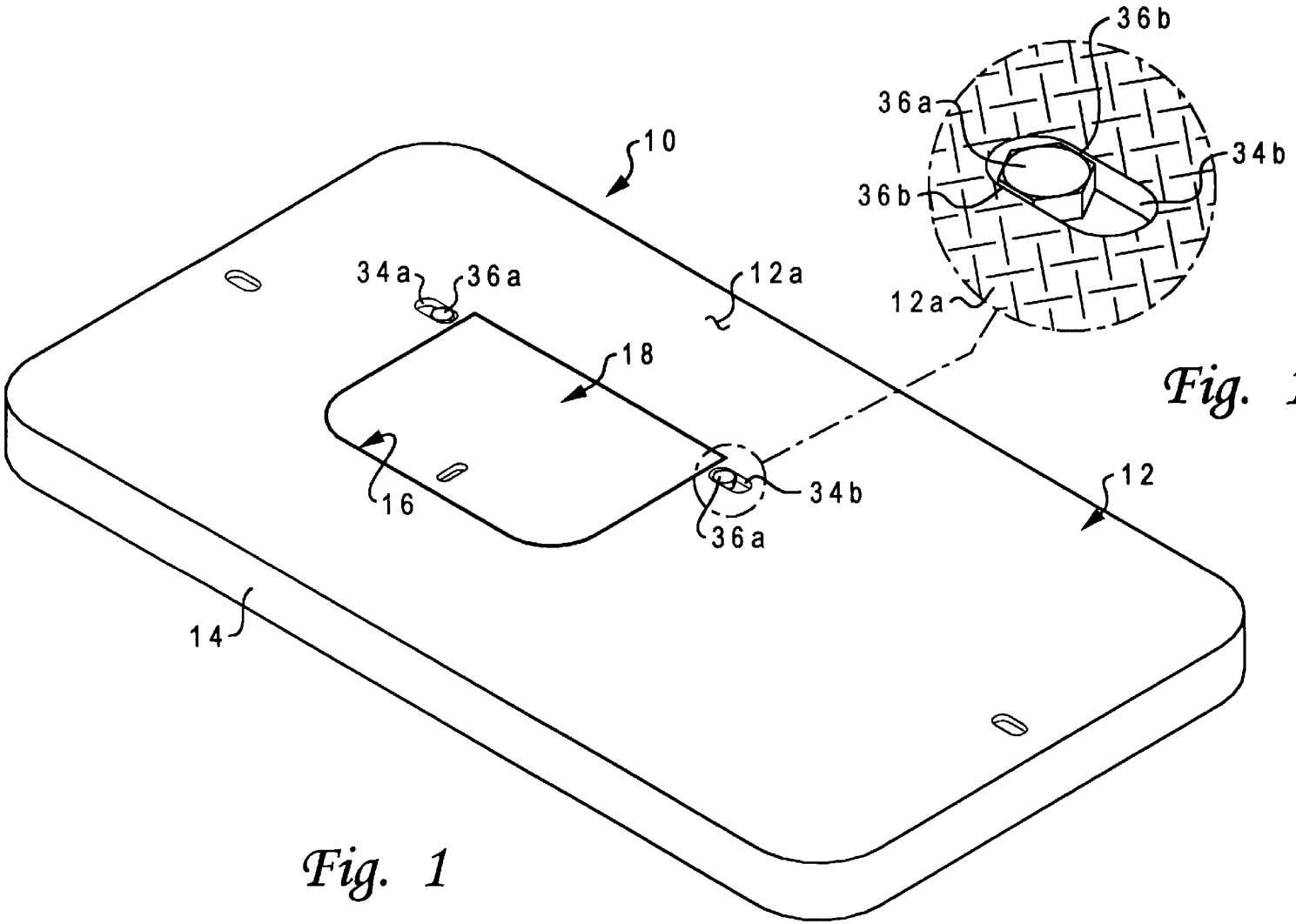
FIG. 1 is a perspective view of a utility meter box cover and access door including the improved hinge connection of the present invention.
FIG. 1A is a detail view on a larger scale showing one of the hinge pin-retaining bolt heads disposed in a slot in the utility meter box cover.

In the description which follows, like parts are marked throughout the specification and drawing with the same reference numerals, respectively. The drawing figures are not necessarily to scale and certain features may be shown exaggerated in scale or in somewhat generalized form in the interest of clarity and conciseness.

Figure 2:
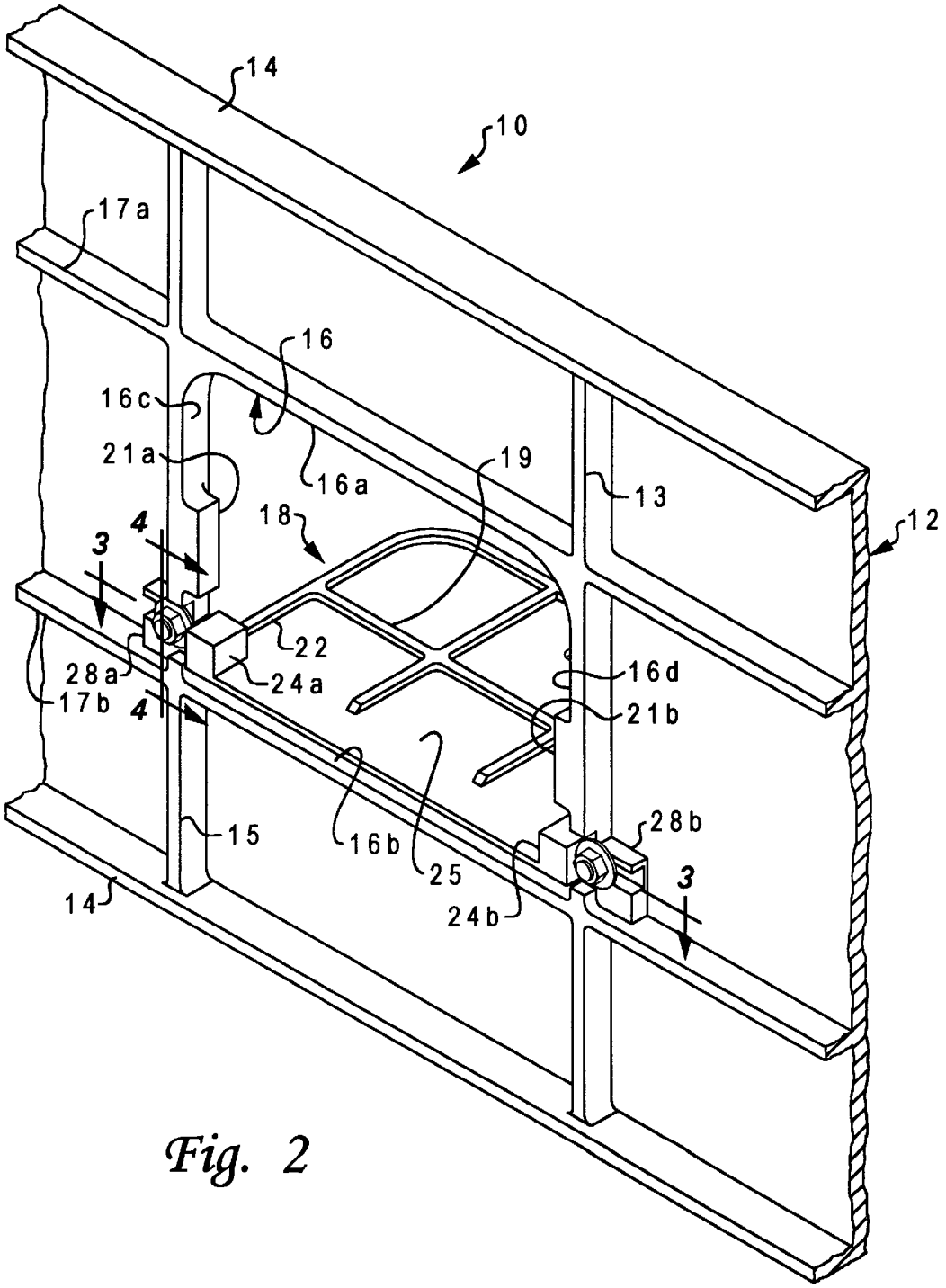
FIG. 2 is a perspective view of the opposite side of the meter box cover and access door showing the door in an open position and showing certain details of the hinge connection between the door and the cover.

Referring to FIG. 1, there is illustrated, by way of example, a generally rectangular panel or cover member 10 comprising a generally planar wall part 12 and a depending peripheral flange 14. The cover member 10 is adapted for use as a utility meter box cover and is preferably formed of cast metal, such as ductile iron. The cover member 10 includes a generally rectangular opening 16 formed therein for disposition of a hinged access door 18 shown in a closed position of the door in FIG. 1. The access door 18 is also preferably formed of a cast metal, such as ductile iron. The access door 18 is hinged for movement between a closed position shown in FIG. 1 and an open position, as shown in FIG. 2. The drawings are lined for metal although those skilled in the art will recognize that the members 10 and 18 may be formed or molded plastic materials also.

FIG. 2 illustrates further features of the cover member 10 indicating that the cover member is preferably formed with integral grid-like reinforcing ribs 13, 15, 17*a* and 17*b* to reinforce the planar wall part 12 and the peripheral flange 14. The generally rectangular opening 16 formed in the cover 10 between the ribs 17*a* and 17*b*, FIG. 2, is defined by opposed walls 16*a*, 16*b* and opposed walls 16*c* and 16*d*, as indicated. Opposed integrally-formed stops 21*a* and 21*b* limit the movement of the door 18 to the closed position shown in FIG. 1. As shown in FIG. 2, the generally planar access door 18 is also provided with integrally-formed ribbing 19, a peripheral flange 22 and opposed integrally-formed hinge pin bosses 24*a* and 24*b*. The access door 18 is preferably cast to include a planar wall part 25 integrally formed with the ribbing 19, the peripheral flange 22 and the hinge pin bosses 24*a* and 24*b*, see FIGS. 2 and 3.

Figure 3:
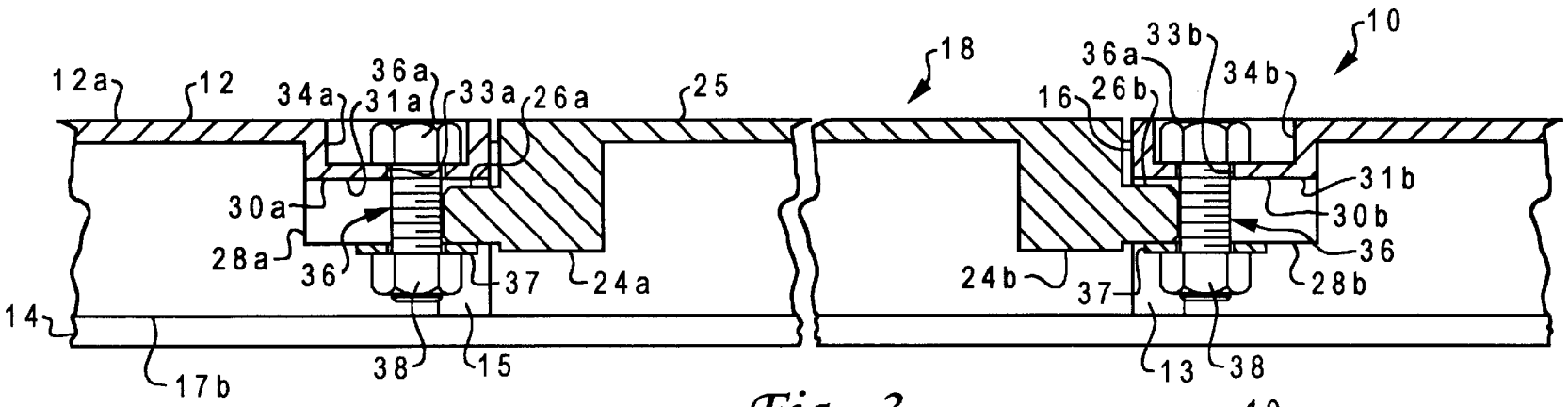
FIG. 3 is a section view taken along the line 3—3 of FIG. 2 showing the access door in the closed position.
Figure 5:
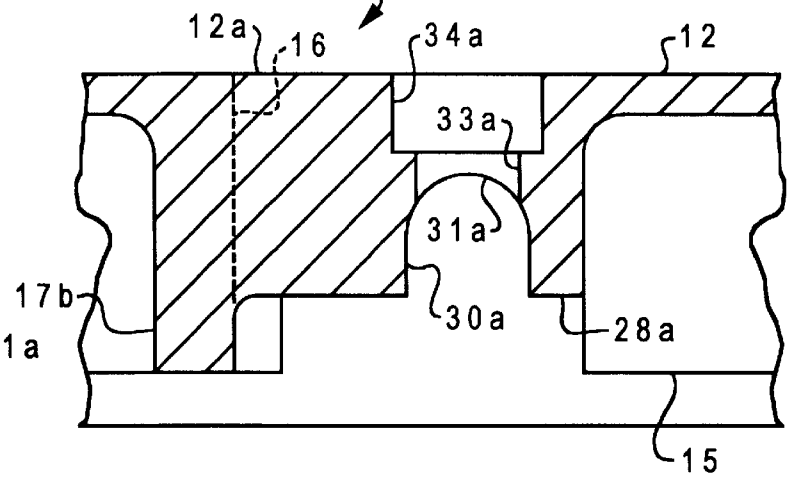
FIG. 5 is a section view similar to FIG. 4 showing one of the channel-shaped recesses of the meter box cover.

Referring primarily to FIG. 3, the door 18 is also advantageously provided with opposed integral, generally cylindrical hinge pins 26*a* and 26*b* which project in opposite directions from the respective bosses 24*a* and 24*b*. The cylindrical hinge pins 26*a* and 26*b* are coaxial and are integrally cast with the remaining parts of the door 18. Referring also to FIG. 2, the cover member 10 is also provided with opposed integrally-cast bosses 28*a* and 28*b* which project in opposite directions from the ribs 15 and 13, respectively, and are provided with channel-shaped recesses 30*a* and 30*b*, see FIG. 3, which open in a direction away from the planar wall part 12 and are also axially aligned with each other. The channel-shaped recesses 30*a* and 30*b* are, as shown by way of example in FIG. 5, provided with semi-cylindrical base wall surfaces 31*a* and 31*b* for receiving respective ones of the hinge pins 26*a* and 26*b* journaled in the channel-shaped recesses 30*a* and 30*b*, respectively. Fastener receiving bores 33*a* and 33*b*, FIG. 3, open into the recesses 30*a* and 30*b* and also open into elongated slots 34*a* and 34*b* which intersect the surface 12*a* of wall part 12.

As shown in FIGS. 1, 1A, 3 and 4, the slots 34*a* and 34*b* are each adapted to receive hex head bolts 36 having hex shaped heads 36*a*, respectively. The bolts 36 project through the respective bores 33*a* and 33*b* and into the respective recesses 30*a* and 30*b*, as also shown in FIG. 3. The depths of the slots 34*a* and 34*b* are such as to provide for the heads 36*a* of the respective bolts 36 to be substantially co-planar with the surface 12*a* and the widths of the slots 34*a* and 34*b* are only slightly greater than the distance across opposed flats 36*b* of the bolt heads 36*a*, see FIG. 1A. In this way, the boltheads 36*a* may be non-rotatably disposed in the slots 34*a* and 34*b*, respectively, substantially co-planar with the surface 12*a* to provide a secure hinge connection, as will be further explained hereinbelow.

Figure 4:
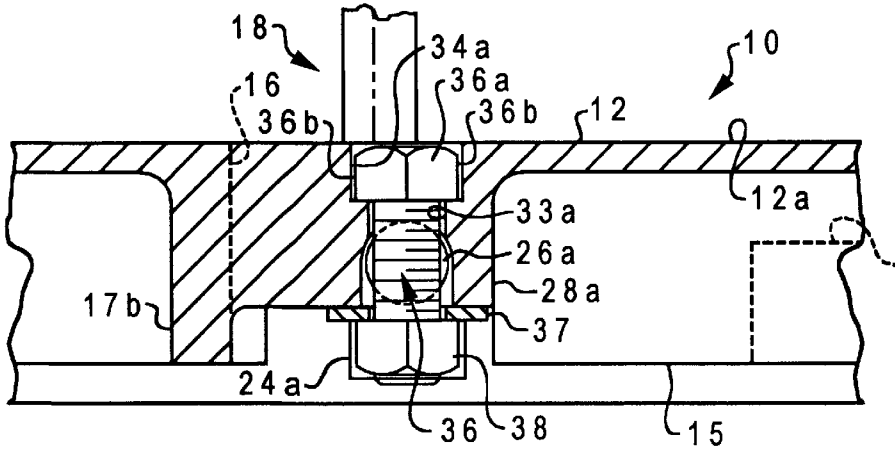
FIG. 4 is a section view taken along the line 4—4 of FIG. 2.

Referring again to FIGS. 3 and 4, each of the bolts 36 is adapted to be retained in one of the respective bores 33*a* and 33*b* by a generally cylindrical washer 37 and hex nut 38, as shown. Alternatively, the nuts 38 can have integral washer faces, if desired. The diameter of each washer 37 is greater than the width of the recesses 30*a* and 30*b*, respectively, so that, when the bolts 36 are assembled to their respective washers 37 and hex nuts 38, as shown in FIGS. 3 and 4, the machine bolt assemblies so formed are adapted to retain the hinge pins 26*a* and 26*b* in the recesses 30*a* and 30*b*. In this way, an uncomplicated but advantageous hinge connection is formed between the cover member 10 and the door 18.

Accordingly, the door 18 may be assembled to the meter box cover 10 by projecting the door through the opening 16 from the side of the cover which includes the bosses 28*a* and 28*b* with the integral hinge pins 26*a* and 26*b* aligned with the recesses 30*a* and 30*b*. With the door 18 generally in the position shown in the drawing figures, the hex head bolts 36 may be projected through the bores 33*a* and 33*b* while the washers 37 and hex nuts 38 are assembled to the bolts and tightened to retain the hinge pins 26*a* and 26*b* within the recesses 30*a* and 30*b*, as shown. The door 18 is now free to be moved between the open position shown in FIG. 2 and the closed position shown in FIGS. 1 and 3, at will. Thanks to the configuration of the slots 34*a* and 34*b* for receiving the bolt heads 36*a*, respectively, the bolts 36 may be tightened without applying a tool to the bolt heads 36*a* and with the box cover member 10 applied to a meter box or similar structure, access to the bolt heads for purposes of disassembling the door 18 from the cover 10 may not be carried out.

Moreover, by providing the door 18 with the opposed integrally-cast hinge pins 26*a* and 26*b*, more complicated casting and possibly machining operations to provide the hinge connection between the door and the cover are obviated. In fact, the assembly of the cover 10 and the door 18 may not require any machining operation except, of course, for fabrication of the bolts 36 and nuts 38. Accordingly, the recesses 30*a* and 30*b*, the bores 33*a* and 33*b*, and the slots 34*a* and 34*b* may all be cast to their final dimensions. The spacing of the bolt receiving bores 33*a* and 33*b* is, as shown in FIG. 3, such as to provide only minimum lateral movement of the door 18 in the opening 16, which movement is substantially precluded by the dimensional relationships between the door and the opening 16. The bolt heads 36*a* may comprise other geometries, such as square or octagonal, for example, rather than conventional hexagonal shapes, as shown.

The construction and operation of the hinge arrangement for a door to a panel or cover member in accordance with this invention is believed to be readily understandable to those of ordinary skill in the art based on a reading of the foregoing description in conjunction with the drawing. Although a preferred embodiment of the invention has been described in detail herein, those skilled in the art will also recognize that various substitutions and modifications may be made to the invention without departing from the scope and spirit of the appended claims.

What is claimed is:

1. A hinge connection between an access door and a panel, such as a utility meter box cover, said hinge connection characterized by:

a panel including a generally planar surface and an opening formed in said panel;

opposed channel-shaped recesses formed in said panel on opposite sides of said opening;

an access door adapted to be disposed in said opening in said panel, said access door including opposed hinge pins adapted to be disposed in said channel-shaped recesses, respectively; and respective bolt and nut assemblies supported on said panel, respectively, and operable to retain said hinge pins in said channel shaped recesses, respectively, to form a hinge connection for pivotal movement of said door with respect to said panel.

2. The hinge connection set forth in claim 1 wherein:

said hinge pins are integrally formed on opposed bosses formed on said access door, respectively.

3. The hinge connection set forth in claim 2 wherein:

said access door comprises one of a metal and plastic casting and said hinge pins are integrally cast as part of said access door.

4. The hinge connection set forth in claim 1 wherein:

said panel comprises one of a metal and plastic casting including said opposed channel-shaped recesses cast therein.

5. The hinge connection set forth in claim 1 wherein:

said panel includes spaced-apart slots formed in said planar surface on opposite sides of said opening for receiving a head portion of respective ones of said bolts of said bolt and nut assemblies, respectively.

6. The hinge connection set forth in claim 5 wherein:

said bolts comprise hex shaped heads and the widths of said slots is only slightly greater than the distance across opposed flats of said heads for non-rotatably retaining said heads in said slots, respectively.

7. The hinge connection set forth in claim 1 wherein:

said channel shaped recesses are formed in opposed bosses integrally cast in said panel, respectively.

8. The hinge connection set forth in claim 7 wherein:

said bolt and nut assemblies each include washer means having a diameter greater than the width of said channel-shaped recesses, respectively, and engageable with said bosses on said panel to form closures over said recesses for retaining said hinge pins therein, respectively.

9. A hinge connection between an access door and a utility meter box cover, said hinge connection characterized by:

a cover member including a generally planar surface and an opening formed in said cover member;

opposed channel-shaped recesses cast in said cover member on opposite sides of said opening;

an access door adapted to be disposed in said opening in said cover member, said access door including opposed integrally cast hinge pins adapted to be disposed in said channel-shaped recesses, respectively; and respective bolt and nut assemblies supported on said cover member, respectively, and operable to retain said hinge pins in said channel shaped recesses, respectively, to form a hinge connection for pivotal movement of said door with respect to said cover member.

10. The hinge connection set forth in claim 9 wherein:

said cover member includes spaced-apart slots formed in said planar surface on opposite sides of said opening for receiving a head of respective ones of said bolts of said bolt and nut assemblies, respectively.

11. The hinge connection set forth in claim 10 wherein:

said bolts comprise hex shaped heads and the widths of said slots is only slightly greater than the distance across opposed flats of said heads for non-rotatably retaining said heads in said slots, respectively.

12. A hinge connection between an access door and a meter box cover, said hinge connection characterized by:

a meter box cover member including a generally planar surface and an opening formed in said cover member;

opposed channel-shaped recesses formed in opposed bosses in said cover member on opposite sides of said opening;

an access door adapted to be disposed in said opening in said cover member, said access door including opposed integral hinge pins adapted to be disposed in said channel-shaped recesses, respectively; and pin retainers supported on said cover member and operable to retain said hinge pins in said recesses, respectively, to form a hinge connection for pivotal movement of said door with respect to said panel, said retainers comprising respective hex head bolt and nut assemblies supported on said cover member, respectively, and operable to retain said hinge pins in said channel-shaped recesses, respectively.

13. The hinge connection set forth in claim 12 wherein:

said cover member includes spaced-apart slots formed in said planar surface on opposite sides of said opening for receiving a head portion of respective ones of said bolts of said bolt and nut assemblies nonrotatably with respect to said cover member, respectively.

14. A utility meter box cover, comprising:

a generally rectangular panel including a planar surface and a generally rectangular opening formed in said surface of said panel;

opposed recesses formed on said panel on opposite sides of said opening and respective spaced apart bores formed in said panel and intersecting said recesses, respectively;

an access door adapted to be disposed in said opening in said panel, said access door including opposed integral hinge pins projecting in opposite directions from opposed sides of said access door and adapted to be disposed in said recesses, respectively; and separate removable pin retainers supported on said panel and projecting within said bores, respectively for retaining said hinge pins in said recesses, respectively, to form a hinge connection for pivotal movement of said door with respect to said panel.

15. The cover set forth in claim 14 wherein:

said panel includes spaced-apart slots formed in said surface on opposite sides of said opening for receiving a head part of respective ones of said retainers, respectively.

16. The cover set forth in claim 15 wherein:

the widths of said slots are only slightly greater than the distance across opposed flats formed on said head parts, respectively, for non-rotatably retaining said head parts in said slots, respectively.

* * * * *